United States Patent [19]

Brock et al.

[11] 4,315,530

[45] Feb. 16, 1982

[54] CONTROL FOR A DOBBY MECHANISM

[75] Inventors: Josef Brock, Viersen; Paul Surkamp, Krefeld, both of Fed. Rep. of Germany

[73] Assignee: Maschinenfabrik Carl Zangs Aktiengesellschaft, Krefeld, Fed. Rep. of Germany

[21] Appl. No.: 77,827

[22] Filed: Sep. 21, 1979

[30] Foreign Application Priority Data

Sep. 22, 1978 [DE] Fed. Rep. of Germany ..... 2841278

[51] Int. Cl.[3] ..... D03C 1/12

[52] U.S. Cl. ..... 139/76

[58] Field of Search ..... 139/66 R, 67, 68, 69, 139/70, 71, 72, 73, 74

[56] References Cited

U.S. PATENT DOCUMENTS 3,804,128 4/1974 Amiques ..... 139/66

FOREIGN PATENT DOCUMENTS 123475 10/1958 U.S.S.R. ..... 139/66 R 320577 1/1972 U.S.S.R. ..... 139/66 R

*Primary Examiner*—Henry Jaudon

*Attorney, Agent, or Firm*—Martin A. Farber

[57] ABSTRACT

Control for a dobby mechanism with a wedge coupling between a drive shaft and an eccentric for the dobby motion, whereby the wedge is couplable and uncouplable with a coupling member in two coupling positions which are diametrically opposite to each other. Each coupling member is connected with one radially moveably mounted switching rod, that the two switching rods being in connection with each other via two control levers (which control levers under spring action are pulled into their starting position) and a coupling rod. One of the two control levers via a balance lever cooperates both with a known needle mechanism and with a control axle, the latter being moved back and forth synchronously in the rhythm of the pressure guides for the needle mechanism, whereas the other control lever is mounted on a fixed pivot axle.

9 Claims, 11 Drawing Figures

CONTROL FOR A DOBBY MECHANISM

The invention relates to a control for a dobby mechanism with a wedge coupling between a drive shaft and an eccentric device for the shaft motion, whereby the wedge is mounted couplably and uncouplably with a coupling member in two coupling positions that are diametrically opposite to each other.

From German Pat. Nos. 2 036 643 and 2 036 644 a dobby mechanism with a wedge coupling of the above-described type is known, with which the control of the wedge takes place by a needle mechanism by means of a pivotally mounted switching arm, which arm, with a closed rim, engages in a groove of the wedge. This control has the disadvantage that with an exchange or replacement of the closed rim, a demounting of the drive shaft is necessary. This is a time-consuming labor which results in a long work standstill or shutdown of the weaving or textile machine.

Further from the German Pat. No. 1 535 207 a notched bar or lifter control for a dobby mechanism is known in which the notched bars or lifters are controlled by means of lifter carriers, the carriers hanging on control levers, and whereby, respectively, two pressing needles are connected with a control lever via a balance lever. With this known hook or lifter control it is achieved that the control lever and therewith the lifter carrier and the lifter (which lifter hangs from the latter) do not execute two successive movements when, during the changing of the lifter, one needle goes into the operative position and the other into the rest position, but rather the control and lifter carrier remain at rest because the opposite movements of the two pressing needles mutually cancel each other out. Thereby the time necessary for the control of the lifters can be considerably reduced.

It is the task of the invention to create a control for the rotation shaft machine with a wedge coupling, which control is easy to maintain and with which in intermittent as well as in continuous operation high rotational speeds of the weaving machine can be attained.

The task is solved in the manner that each coupling member is connected with respectively one radially moveably mounted switching rod each, that the two switching rods are in connection with each other via two control levers (which control levers under spring action are pulled into their starting position) and a coupling rod, that one of the two control levers via a balance lever cooperates both with a known needle mechanism and with a control axle, which control axle is moved back and forth synchronously in the rhythm of the pressure guides for the needle mechanism, whereas the other control lever is pivotally mounted on a fixed pivot axle.

A control that is formed according to the invention has the advantage that, in case of a damage in the control, a disassembling of the drive shaft is not necessary, and as a result of an exact movement of the coupling members for the wedge not only with intermittent but also with continuous operation, high speeds of the weaving machine or textile loom can be achieved. Furthermore a control formed according to the invention is remarkable in that it utilizes the advantages of the known construction principle of the notched bar control with a balance lever for the control of a wedge coupling.

With a practical embodiment of a control formed according to the invention one control lever with oblong holes can be arranged on the control axle as well as on a pivot axle of the balance lever.

Furthermore it has proven advantageous to correlate or adjust the lengths of the levers to each other such that a stroke produced by the needle mechanism on the pivot axle of the balance lever is cancelled or neutralized by means of a corresponding stroke of the control axle such that at the control end of the control lever a standstill occurs when the coordinated shaft is supposed to stay in its upper shed position. A coupling path is produced at the control end of the control lever, instead by the movement of the control axle when the needle mechanism is not moved.

Further details, characteristics, and advantages of the subject matter of the invention will be seen in the herebelow descriptions of the accompanying drawings in which preferred embodiments of a dobby mechanism with a control formed according to the invention, are shown schematically in plan views and sections.

The drawings show:

Figure 1:
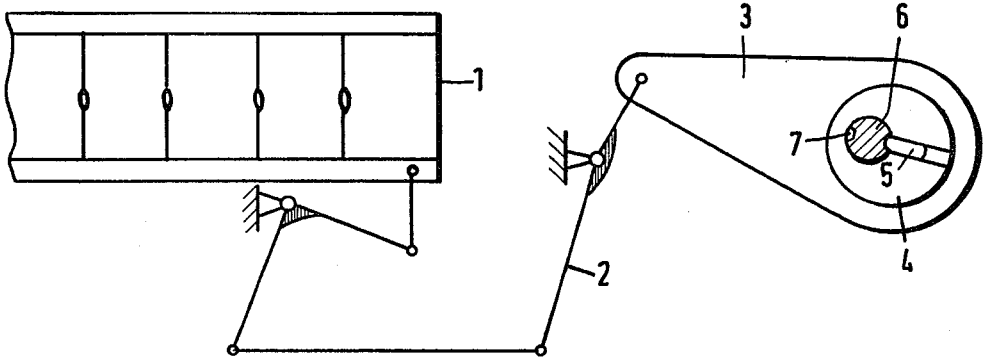
FIG. 1 is a schematic view of a dobby drive in the bottom shed position.
Figure 2:
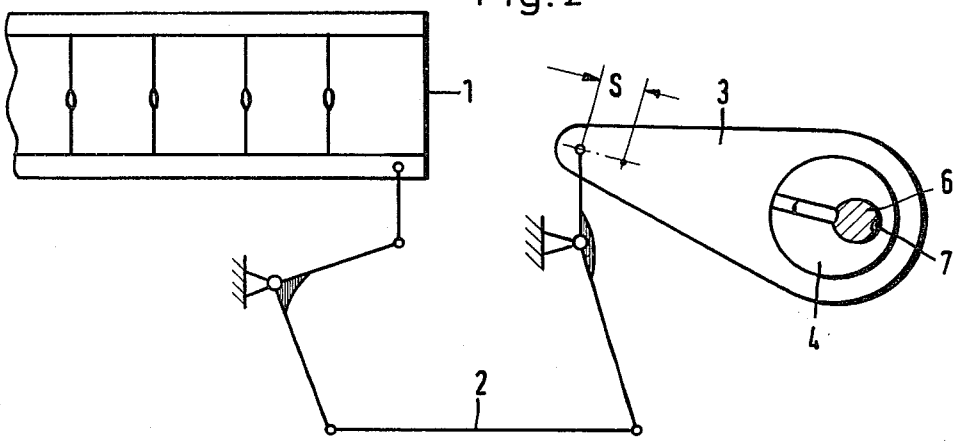
FIG. 2 is a schematic view of a dobby drive in the upper shed position.
Figure 4:
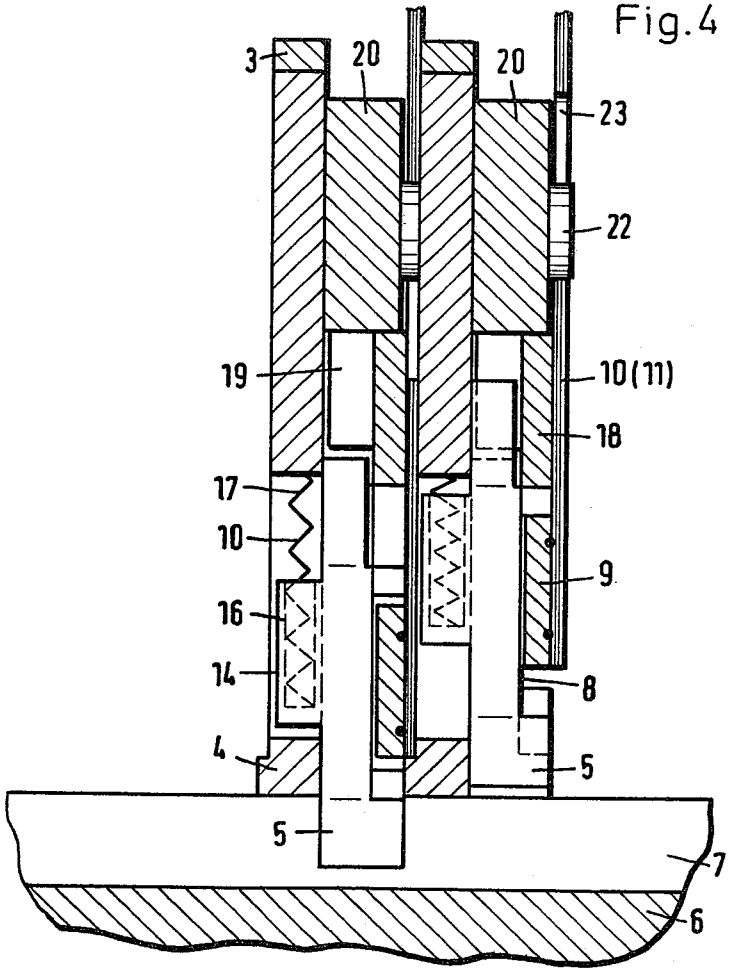
FIG. 4 is the same wedge coupling with one coupled and one uncoupled wedge, cut along the line IV—IV in FIG. 3.
Figure 3:
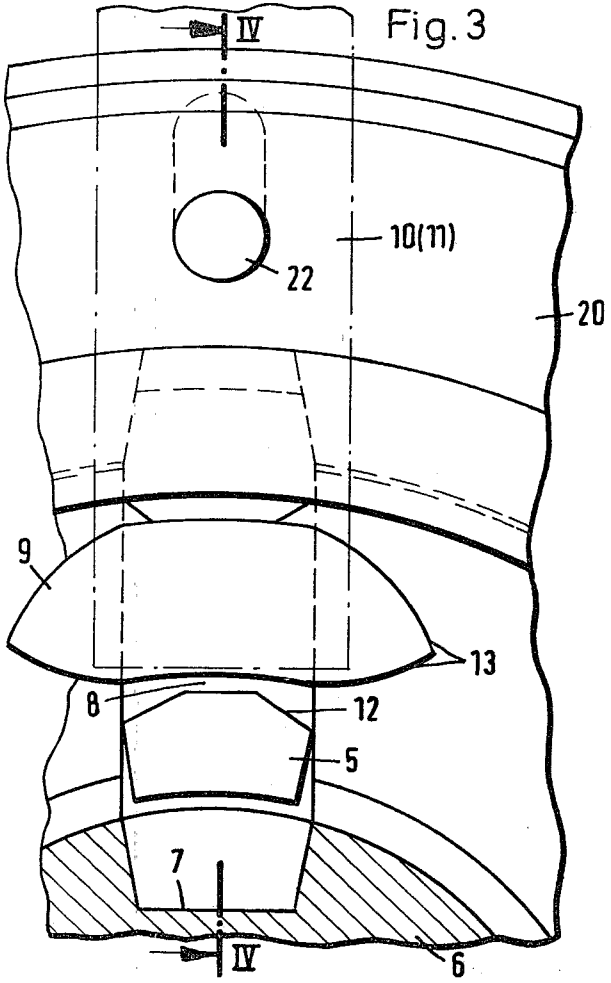
FIG. 3 is a side view of a vee- or wedge coupling.

A dobby 1 is moved via a transmission or gearing 2 from the bottom shed position (shown in FIG. 1) into the upper shed position (shown in FIG. 2) or in the reverse order by a connecting rod 3, which rod 3 is mounted on an eccentric disc 4. For this purpose the eccentric disc 4 can be coupled with a drive shaft 6 by means of a radially displaceably arranged wedge 5, which shaft 6 has two axially extending grooves 7 for the engagement of the wedge 5, the grooves 7 being diametrically opposite to each other. The eccentric disc 4 which is coupled with the drive shaft 6 by means of the wedge 5 moves the connecting rod 3 upon a half rotation by the path s from the bottom shed position into the upper shed position or in the reverse order. The wedge 5 has a groove 8 that is open in the axial direction, into which groove 8 a coupling member 9 engages. One coupling member 9 is attached on each of the ends of two switching rods 10 and 11, the switching rods 10 and 11 being diametrically opposite to each other and controllable according to a pattern or design. The entrance and exit of the groove 8 in the wedge 5 are provided with bevelled or inclined surfaces 12, whereas the ends of the coupling member 9 are provided with cam surfaces 13 in order to guarantee a disturbance-free up and down movement of the wedge 5.

Each wedge 5 on its rear side is provided with an attachment or shoulder 14, which shoulder 14 engages in a radially extending recess 15 of the eccentric disc 4, the shoulder 14 being provided with a blind end bore or blind hole 16 into which bore 16 a compression spring 17 is inserted. The wedge 5 is biased by the compression spring 17 in the direction toward the groove 7 of the drive shaft 6 and during its rotation is pressed into the groove 7.

After the arrival of a coupled wedge 5 into the coupling area, by means of coupling element 9 the wedge 5 is pulled from out of the groove 7 of the drive shaft 6 in opposition to the action of the compression spring 17 and therewith is uncoupled. The coupling of the wedge 5 in the groove 7 of the drive shaft 6 occurs by means of a correspondingly reversed stroke of the coupling element 9 and by means of the compression spring 17.

Above the wedge 5 a ring 18 is arranged concentrically to the drive shaft 6, which ring 18 has in the vicinity of the two switching rods 10 and 11, two axially extending slots 19, in which slots 19 the outer end of the wedge 5 engages in the decoupled position. The ring 18 with an overlapping radially inwardly directed annular projection 18*a* overlaps the outer end of the wedge 5 even still in the coupled position, so that an axial displacement of the wedge 5 is impossible even during its rotation.

The ring 18 is fixed in its normal operating position by means of a spring-loaded locking or blocking wedge 21, but is rotatably mounted in a fixed or stationary guide ring 20, so that in the case of a wrong switching or faulty control in which the wedge 5 still extends partially into the slot 19 the ring 18 is able to yield in the and rotate therealong in the circumferential direction.

Pins or pegs 22 are attached to the guide ring 20, on which pegs 22 the switching rods 10 and 11 are guided with, respectively, one longitudinal hole 23 each.

The two switching rods 10 and 11 are connected at their outer ends with two control levers 25 and 26 via pins 24, which control levers in their turn are connected with each other via a coupling rod 27 and pivot axles 28 and 29.

A balance lever 30, to which lever 30 two pressing needles 31 are articulated, engages on the pivot axle 28 of the control lever 25. The pressing needles 31 are in connection with sensing needles 32, which needles 32 sense a paper card (not illustrated), the card being moved by a card cylinder 33. A hole in the paper card signifies that the sensing needles 32 fall in and shift the pressing needles 31 into the movement path of sliding rails or pressure guides 34.

The control lever 25 is formed with an oblong hole 35 and is mounted thereat on a control axle 36, which axle 36 is moved back and forth in rhythm together with the pressure rails 34. The control lever 26 on the other hand is mounted on a fixed or stationary pivot axle 37. Both control levers 25 and 26 are pulled into their starting position by tension or draw springs 38.

Figure 5:
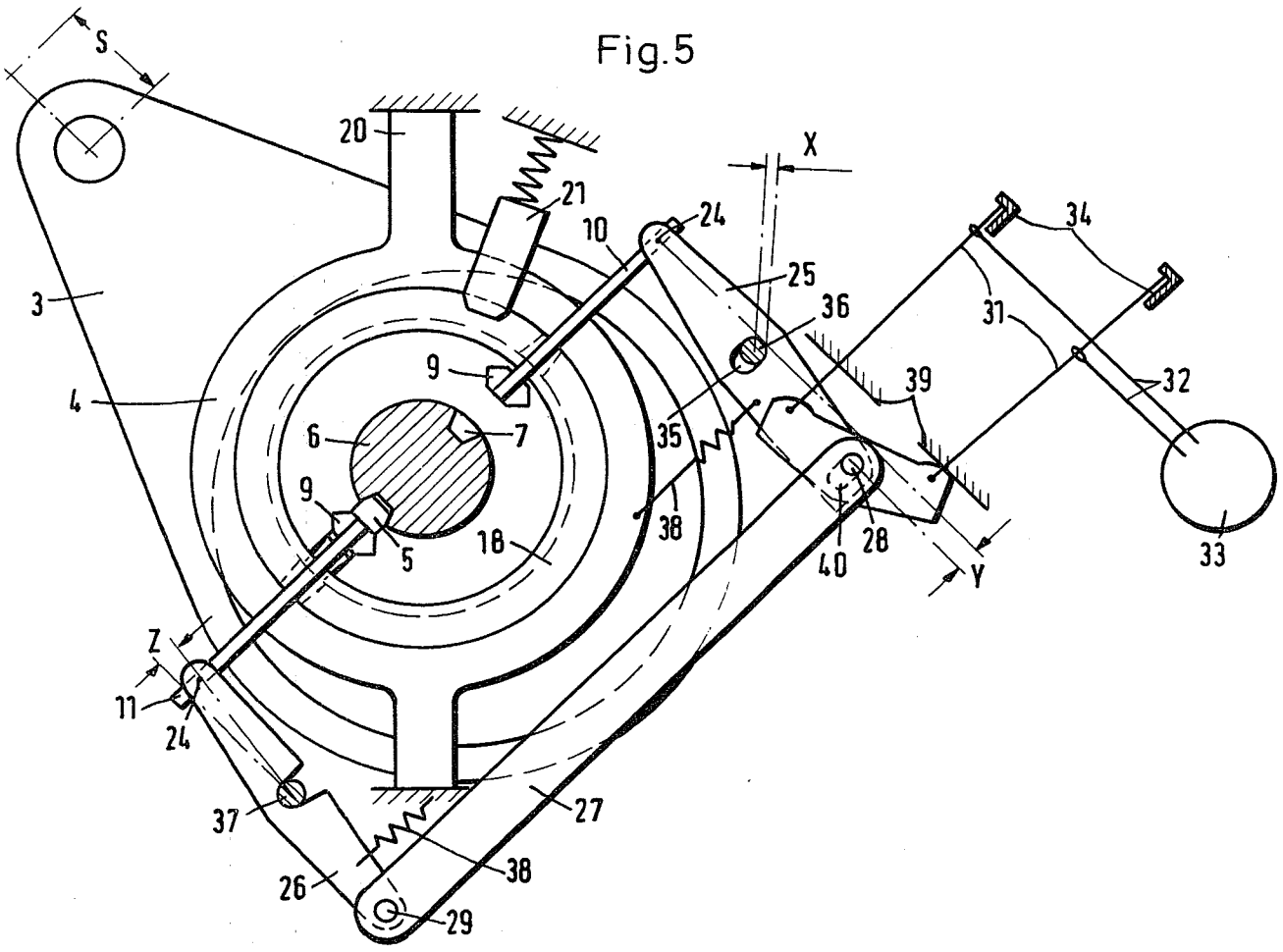
FIGS. 5–8 are schematic drawings in side view of a control device for the wedge coupling for the movement of the dobbies from the bottom shed to the upper shed or in the reverse direction and for holding the dobbies fixed in the bottom shed or upper shed.
Figure 5A:
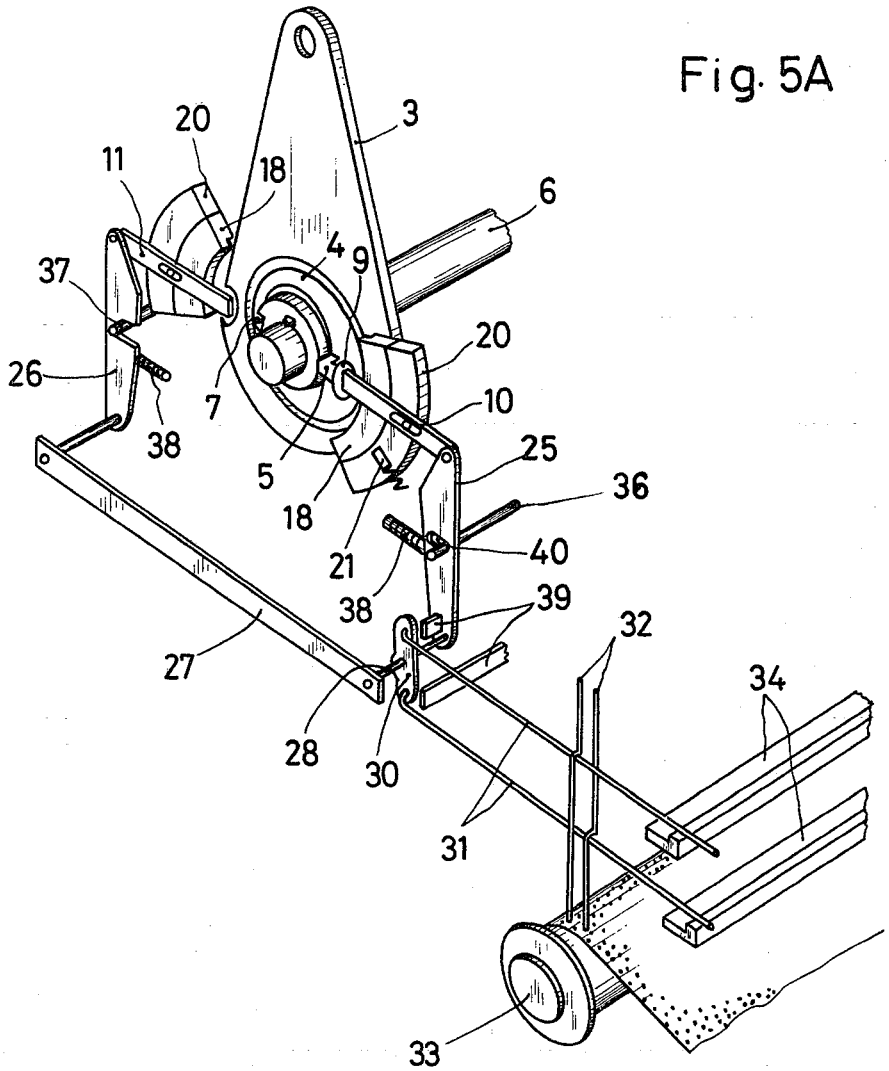
FIG. 5A is a perspective schematic illustration of the control device according to FIG. 5.

The control device for a wedge coupling formed according to the invention, shown in FIGS. 5 to 8 and 5A, is very simple in its construction and operates as follows:

With the lower shed position shown in FIG. 5, the sensing needles 32 have found a hole in the paper card, so that the pressure needles 31 have lifted the balance lever 30 off a support 39 and thereby have displaced the pivot axle 28 by the path y, which path y, via the coupling rod 27 and the control lever 26, produces a coupling path Z at the pin 24 of the switching rod 11 since the control lever 26 pivots about the fixed pivot axle 37, so that the wedge 5 has become coupled in the groove 7 of the drive shaft 6.

No coupling path z has been produced on the pin 24 of the other switching rod 10 because the control axle 36 was displaced by the path x simultaneously with the pressure rail guides 34.

Figure 6:
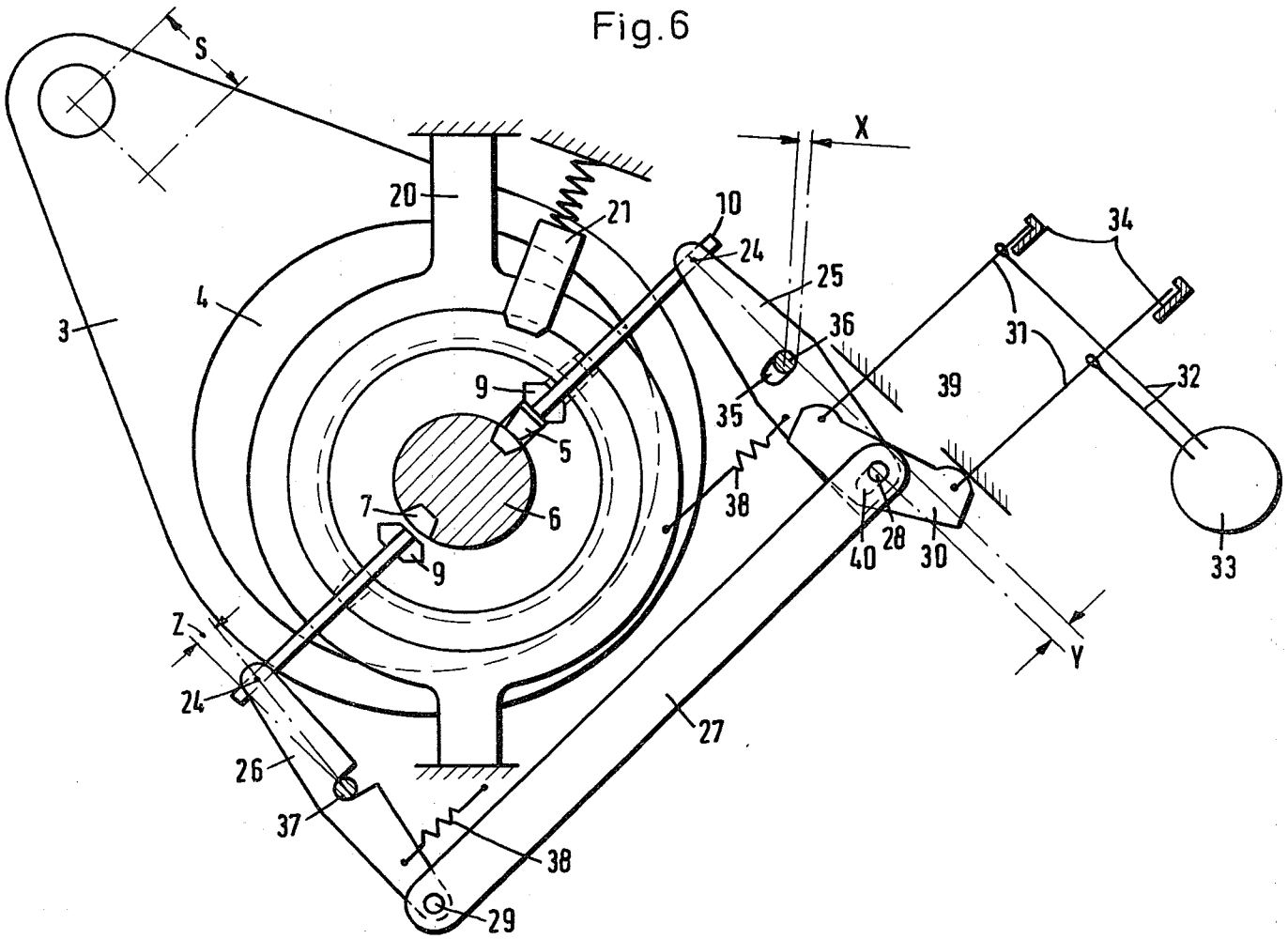

In the upper shed position shown in FIG. 6, after a one-half rotation of the eccentric disc 4, the wedge 5 ran up on the coupling member 9 of the switching rod 10 and was uncoupled from the groove 7 in the drive shaft 6. The control position shown in FIGS. 5 and 6 signifies at the same time that a wedge 5, uncoupled by the switching rod 10, is not coupled, thus the dobby should stay in its upper shed position.

Figure 7:
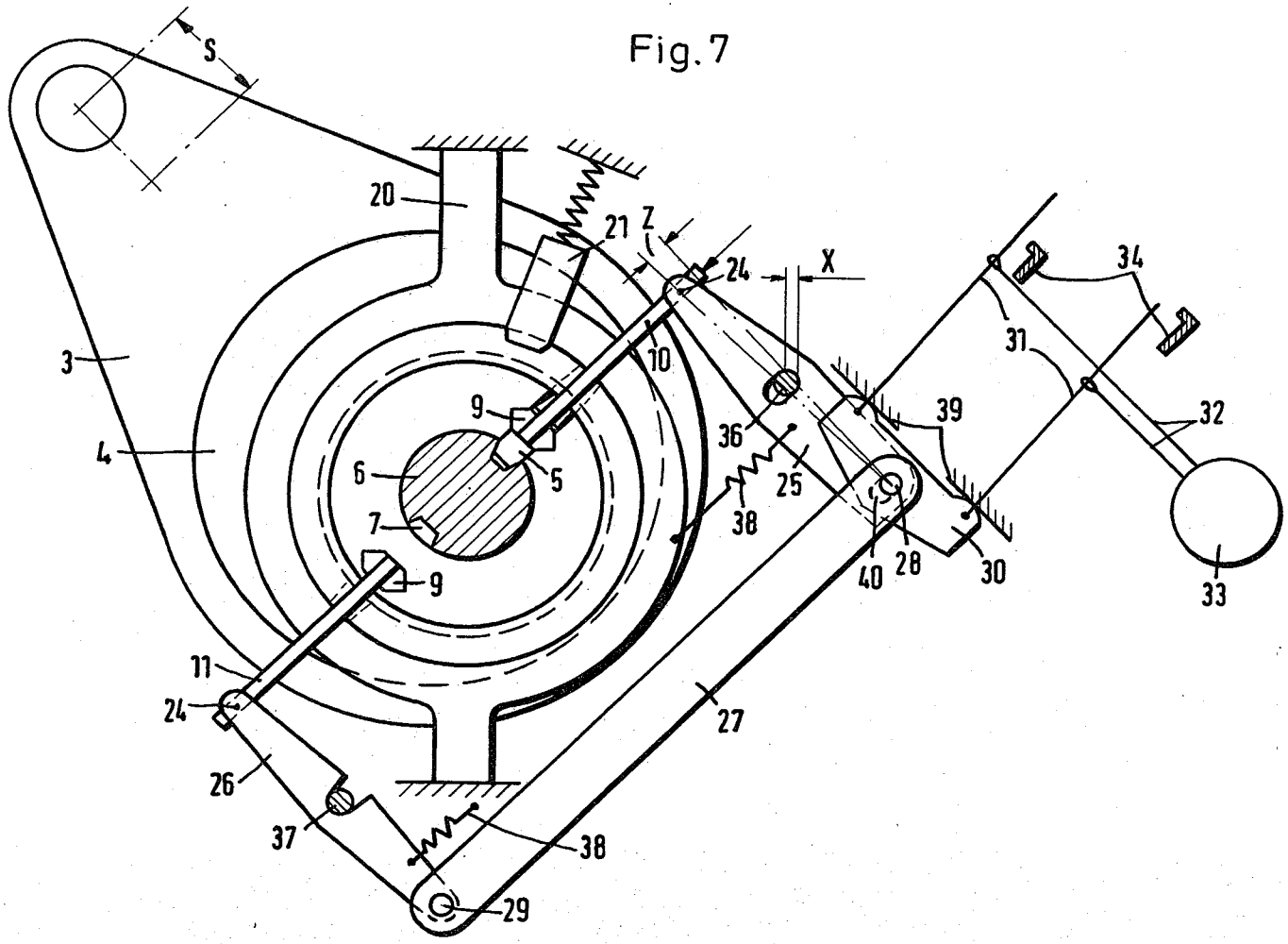
Figure 8:
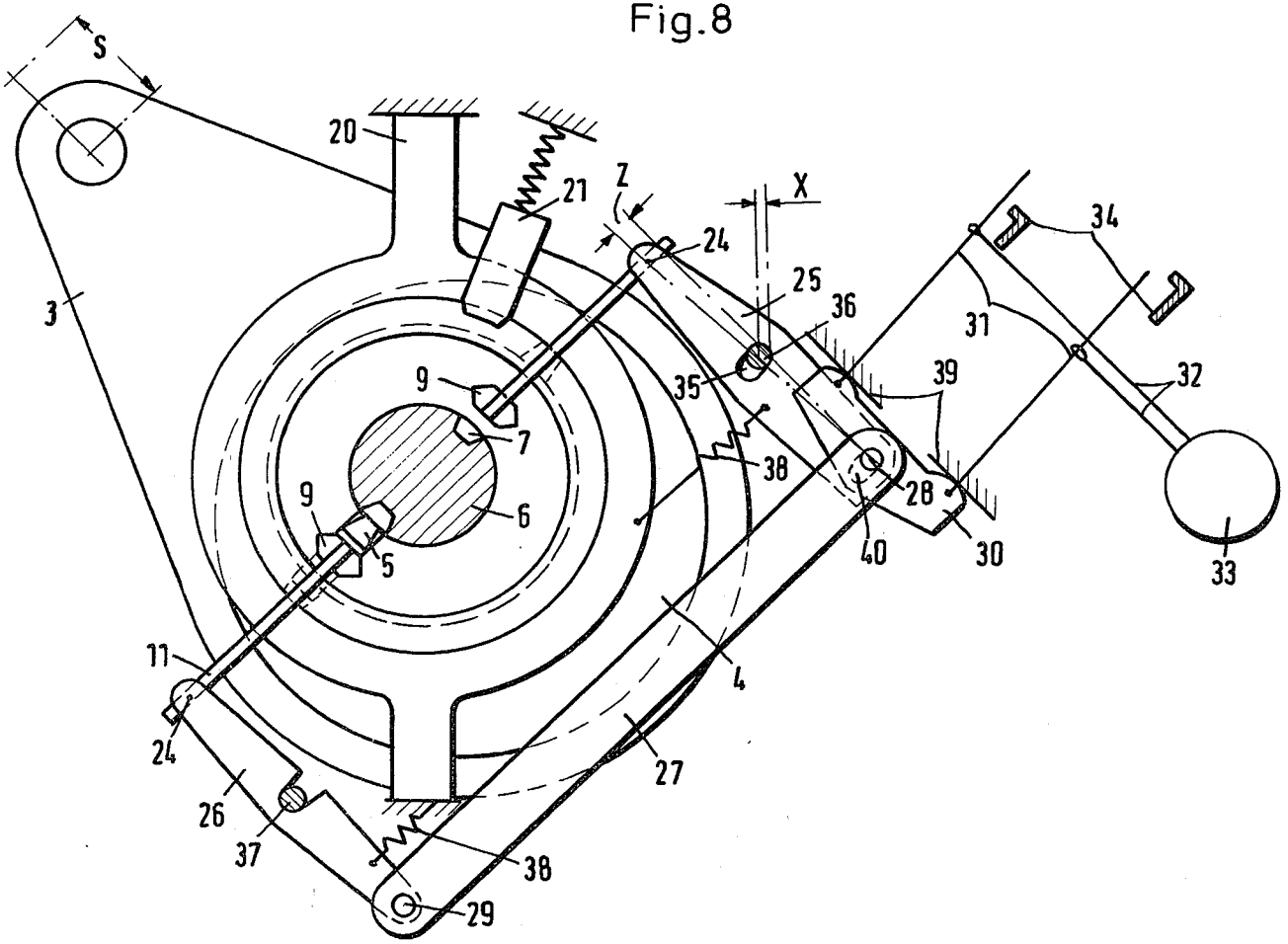

In the upper shed position shown in FIG. 7 the sensing needles 32 have found no hole in a paper card, so that the pressing needles 31 thus do not project into the path of movement of the pressing rails or pressure guides 34 and therefore are not pressed or driven out. The balance lever 30 remains in abutment on its supports 39, so that the pivot axle 28 also is not displaced. Since however the control axle 36 of the control lever 25 was displaced by the path x during standstill of the pivot axle 28, a coupling path z is produced on the pin 24 of the switching rod 10, so that the wedge 5 is again coupled into the groove 7 of the drive shaft 6. Upon a half rotation of the eccentric disc 4 the dobby is moved again from the upper shed position shown in FIG. 7 to the bottom shed position shown in FIG. 8. The control position shown in FIG. 8 signifies at the same time that the dobby 1 remains in the bottom shed position since the wedge 5 no longer couples the drive shaft 6 to the eccentric disc 4.

For the equalization or compensation of manufacturing tolerances, and for the avoidance of jammings in the control, the control lever 25 is formed with an oblong hole 40 and is mounted thereat on the pivot axle 28.

Figure 10:
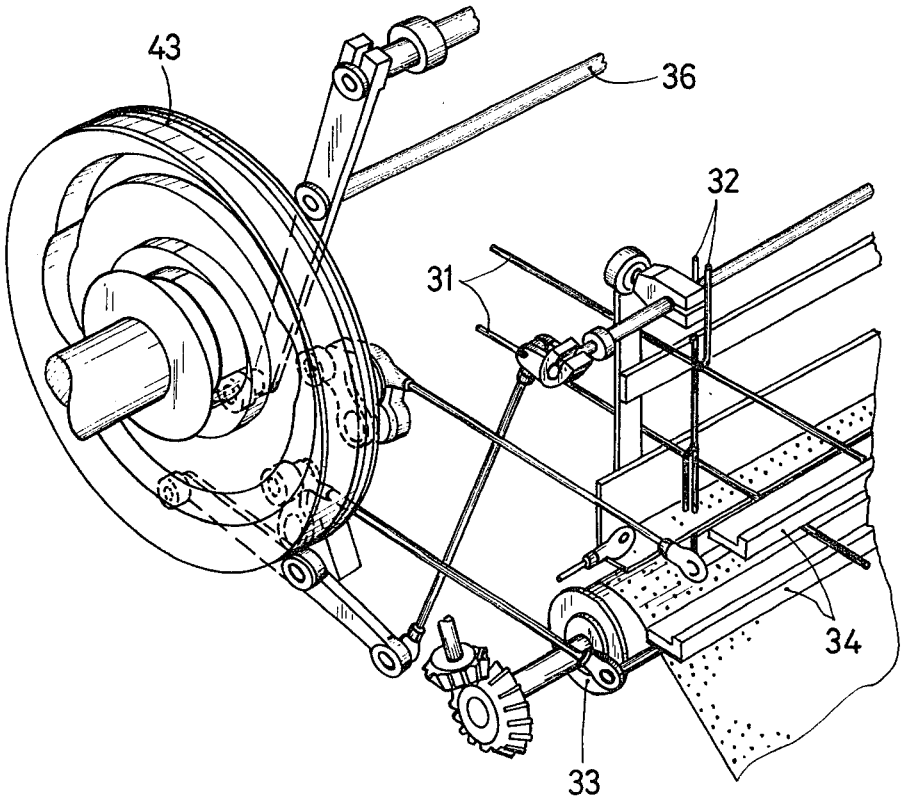
FIG. 10 is a perspective view of a drive device for the pressing rails of the needle mechanism and the movably control axle.

As one example only, the drive device for both pressure rails 34 and the moveable control axle 36 is seen in FIG. 10, which may be a separate cam disc 43 which is driven by the weaving machine, from which the back and forth movements for the pressure rails 34 and the moveable control axle 36 can be taken off.

Figure 9:
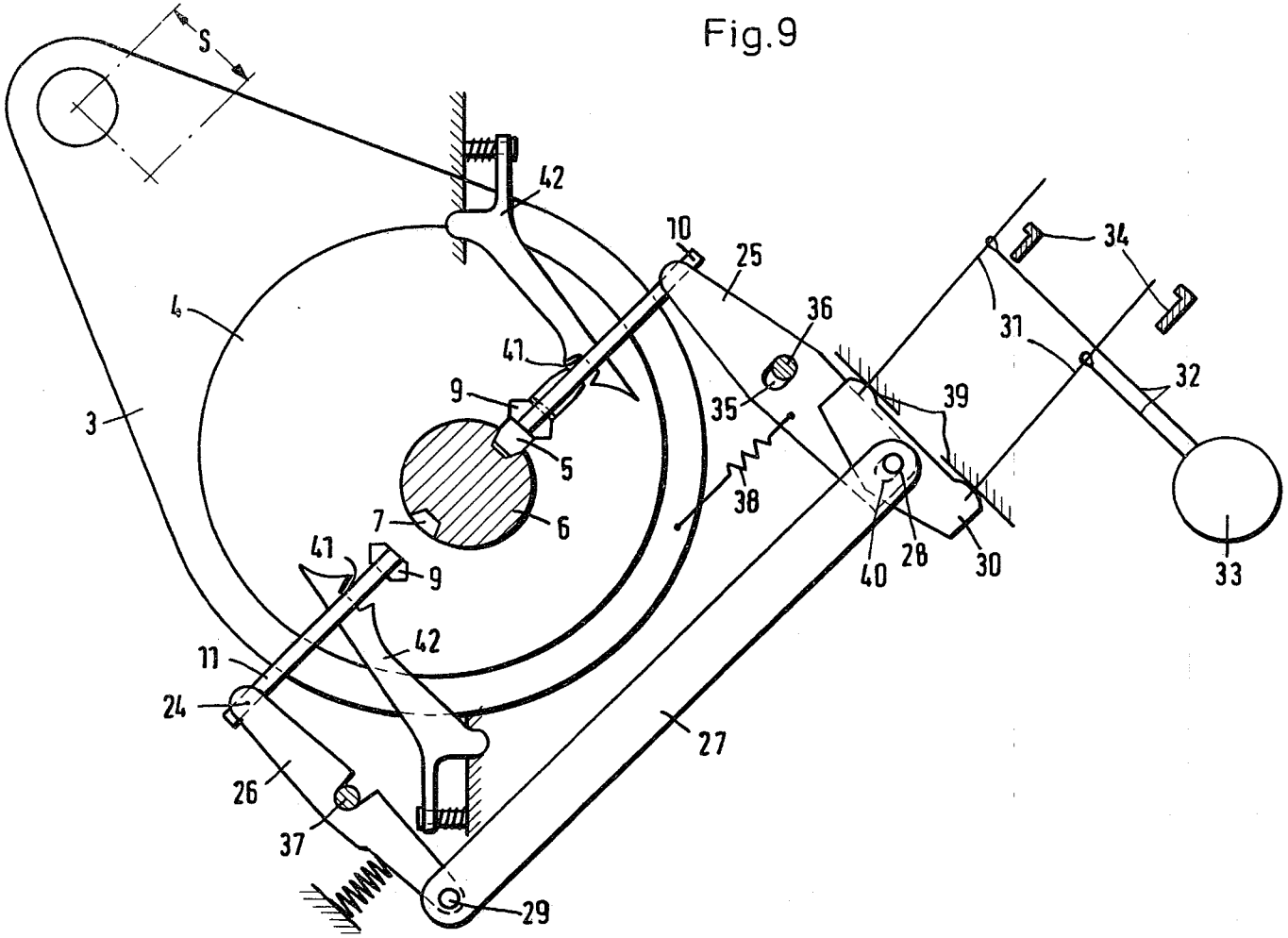
FIG. 9 is a schematic illustration of a side view of another embodiment of the wedge coupling.

In FIG. 9 a different embodiment of a wedge coupling created according to the invention is shown, in which the ring 18 and the stationary guide ring 20 are omitted in the drawings and not necessary. The outer end of the uncoupled wedge 5 is able to engage or catch in a recess 41 of resilient pawls or detents 42. Otherwise the drive and control remain unchanged.

All new features mentioned in the description and shown in the drawings are important to the invention, including insofar as they have not been claimed in the following claims.

We claim:

1. In a control for a dobby mechanism with a wedge coupling between a drive shaft and an eccentric for the shaft motion, whereby the wedge is couplable and uncouplable with a coupling member in two coupling positions which are diametrically opposite to each other, the improvement comprising two radially moveably mounted switching rods, each coupling member is connected with each one of said radially moveably mounted switching rods, respectively, two control levers and a coupling rod operatively connected and constituting means for connecting said two switching rods with each other, spring means for pulling said control levers under spring action into starting positions thereof, a moveable needle mechanism, pressure guides constituting means cooperating with the needle mechanism, a control axle means for being moved back and forth synchronously with the rhythm of said pressure guides, a balance lever operatively connected with said needle mechanism and with one of said two control levers, the latter one via said balance lever cooperating with said needle mechanism and cooperating with said control axle means, a fixed pivot axle, the other of said control levers is mounted on said fixed pivot axle.

2. The control according to claim 1, further comprising a pivot axle of said balance lever, said one control lever is formed with oblong holes arranged on said control axle means as well as on said pivot axle of said balance lever.

3. The control according to claim 2, wherein said needle mechanism constitutes means for producing a stroke on the pivot axle of the balance lever, said control axle means for undergoing a corresponding stroke such that at a control end of said one control lever a standstill occurs.

4. The control according to claim 5, wherein said control axle means for producing a control stroke at a control end of said one control lever when said needle mechanism is not moved.

5. The control according to claims 3 and 4, wherein said control end of said one control lever is connected to one of said switching rods.

6. The control according to claim 1, further comprising a displaceable pivot axle pivotally connected to said balance lever and to one end of said one control lever and one end of said coupling rod, the other end of said coupling rod is pivotally connected to said other control lever, and the other ends of said control levers are pivotally connected to said switching rods, respectively.

7. The control according to claim 6, wherein said spring means for biasing said one ends of said control levers in a direction toward each other.

8. The control according to claim 6, wherein said other control lever is formed with an edge recess in which said fixed pivot axle is positioned.

9. The control according to claim 1, wherein said one control lever is formed with an oblong hole in which said control axle means is mounted.

* * * * *